US005455973A

United States Patent [19]

Brumfield et al.

[11] Patent Number: 5,455,973

[45] Date of Patent: Oct. 10, 1995

[54] CUSHION COVER WITH ADJUSTABLE PERIPHERAL SIDEGUARD

[76] Inventors: Barbara A. Brumfield; Patrick H. Brumfield, both of 9684 W. Purdue Ave., Pioria, Ariz. 85345

[21] Appl. No.: 247,762

[22] Filed: May 23, 1994

[51] Int. Cl.[6] ..... A47C 21/08

[52] U.S. Cl. ..... 5/424; 5/655

[58] Field of Search ..... 5/424, 490, 655, 5/448, 465, 474, 470, 499, 495

[56] References Cited

U.S. PATENT DOCUMENTS

| | | | |
|---|---|---|---|
| D. 323,442 | 1/1992 | Trader | D6/602 |
| 2,576,455 | 11/1951 | Gratt | 5/354 |
| 2,851,703 | 9/1958 | Greco | 5/334 |
| 3,863,283 | 2/1975 | Mohr | 5/490 |
| 4,788,726 | 12/1988 | Rafalko | 5/424 |
| 4,959,880 | 10/1990 | Tesch | 5/490 |
| 5,081,729 | 1/1992 | Menday | 5/487 |
| 5,144,911 | 9/1992 | Moore et al. | 119/285 |
| 5,351,348 | 10/1994 | Beger | 5/655 |

FOREIGN PATENT DOCUMENTS

| | | | |
|---|---|---|---|
| 868320 | 5/1961 | United Kingdom | 5/474 |
| 943965 | 12/1963 | United Kingdom | 5/655 |

*Primary Examiner*—Alexander Grosz

*Attorney, Agent, or Firm*—David L. Baker; Henry S. Miller; Rhodes & Ascolillo

[57] ABSTRACT

A reversible cover adapted to protect the cushion used with infant furniture comprising a upper and lower half sewn together on three sides and releasably closed on the remaining side. A protective cushion, having a radial tab, is attached at the juncture of the upper and lower halves and is adapted to extend above the cushion regardless of which side of the cushion receives the infant. The cover is reversed by simply turning the cushion over.

11 Claims, 2 Drawing Sheets

CUSHION COVER WITH ADJUSTABLE PERIPHERAL SIDEGUARD

BACKGROUND OF THE INVENTION

1. Field of the Invention

This invention relates generally to furniture and more particularly to the covering for cushions used with infant furniture.

2. Description of the Prior Art

Many changes have been made in infant furniture in recent times with the availability of new materials and manufacturing processes. One factor that seems to remain constant is that infants are always given a soft warm place to recline, not unlike their parents and other adults. One difference is that infants tend to remain in one place for longer periods of time than adults once they recline. As a result of being infants and as a result of immobility, the covering on the cushion where the infant lies tends to become soiled faster then the average juvenile or adult cover. In order to provide some relief for those parents or other adults who have the responsibility for caring and changing cushion covers many suggestions have been put forth. For example, U.S. Pat. No. 2,576,455 issued Nov. 27, 1951 to Gratt shows an orthopedic pad with a slot in the cover for inserting a board. The slot is closed by means of a zipper. Greco in U.S. Pat. No. 2,851,703 issued Sep. 16, 1958 shows a fitted sleeping cover to prevent the cover from being readily kicked off by a sleeper. The cover is open on the bottom side and not reversible. U.S. Pat. No. 5,144,911 issued Sep. 8, 1992 to Moore et al., discloses a component bed system, albeit for a pet. The prime features of the invention are a mattress cover forming a pocket and a pad that mounts on the pad. The U.S. Pat. No. 5,081,729 to Menday shows a disposable fitted birthing sheet where the mattress is fitted into the sheet from the bottom-middle but the sheet surrounds the mattress in a rather conventional manner, and the design patent to Trader U.S. Pat. No. Des. 323,442 issue Jan. 28, 1992 shows a cushion cover that is removeably attached on at least part of two sides.

The prior art is devoid of a truly reversible cushion cover that includes a separate protective cushion that will extend above the infant receiving side of the main cushion regardless of which side is used as the infant receiving side.

SUMMARY OF THE INVENTION

The invention is characterized by an envelope formed in the shape of an infants cushion depending upon the use. The envelope has a top half and a bottom half which are joined along the midpoint of the vertical side of the cushion on three sides. The remaining side is releasably closed by a zipper or Velcro. In addition, a protective cushion, which is circular in cross section and covered with a material having a tab extending radially outward is secured to the envelope at the juncture of the two halves around the entire envelope.

It is therefore an object of the invention to provide a new and improved reversible safety cover for an infant cushion.

It is another object of the invention to provide a new and improved reversible cover for an infant cushion that is simple and easy to use.

It is a further object of the invention to provide a new and improved reversible cover for an infant cushion that are quickly reversible.

It is still another object of the invention to provide a new and improved cover for and infant cushion that incorporates only one seam.

It is still a further object of the invention to provide a cover for an infant cushion that will resist wrinkles and not pull free.

It is another object of the invention to provide a safety cover for an infant cushion that may be easily and efficiently manufactured and marketed.

It is another object of the invention to provide a safety cover for an infant cushion that is low in cost.

It is another object of the invention to provide a safety cover for an infant cushion that will stimulate infant motor development.

These and other advantages, features and objects of the invention will become more apparent from the following description taken in connection with the illustrative embodiment in the accompanying drawings.

DESCRIPTION OF THE PREFERRED EMBODIMENT

Figure 1:
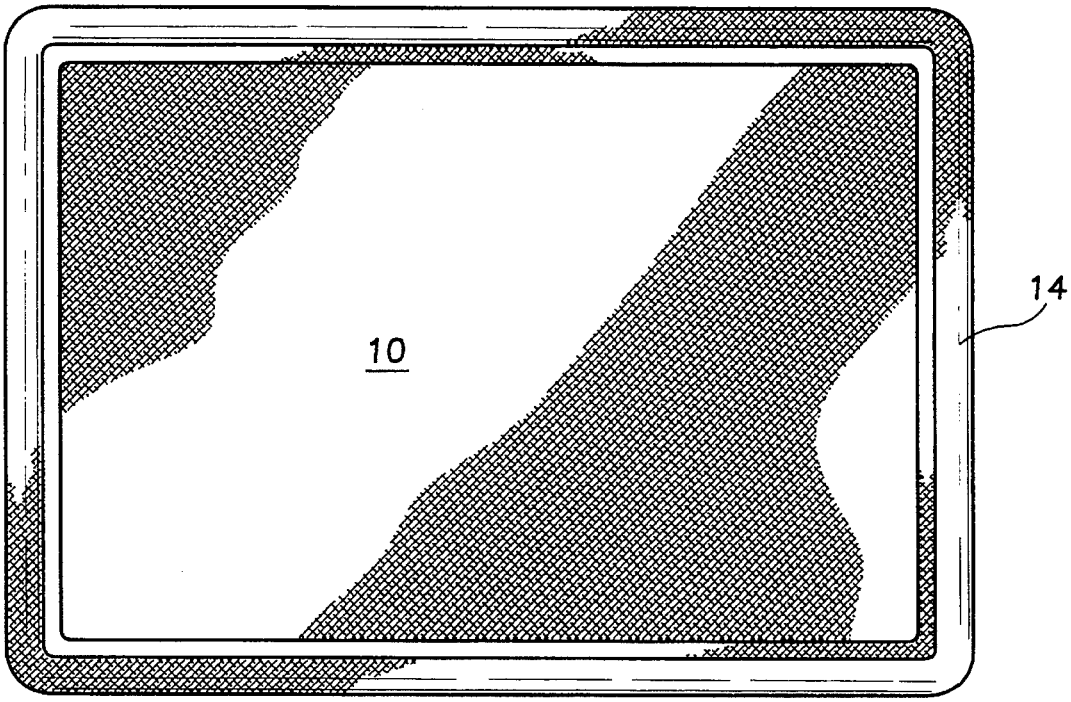
FIG. 1 is a plan view of the invention.
Figure 2:
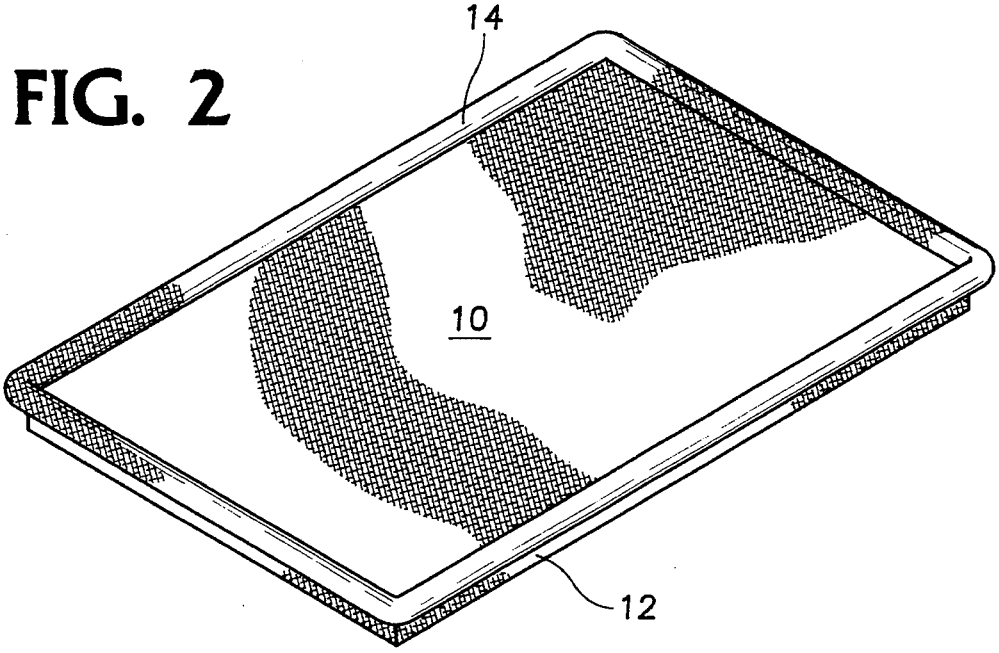
FIG. 2 is a perspective view of the invention.

Referring now to FIGS. 1 and 2, the cover of the invention is shown covering a cushion and consists of a top half 10 a bottom half 12 and a protective cushion 14 enclosing the entire perimeter of the cover.

Figure 3:
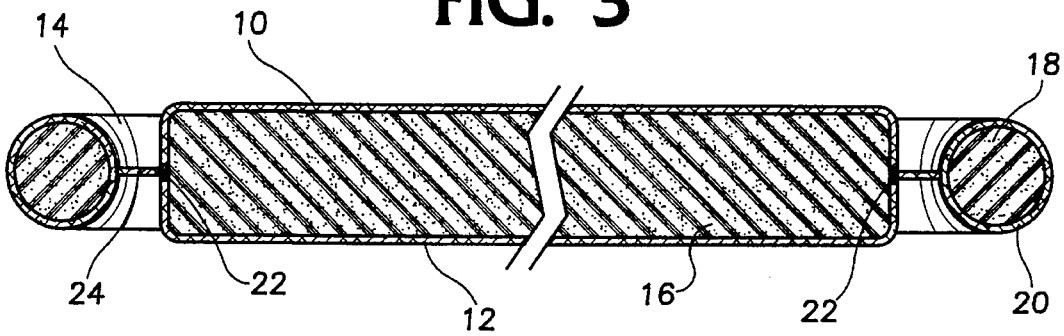
FIG. 3 is a cross sectional view if the invention with the protective pad in a neutral position.
Figure 4:
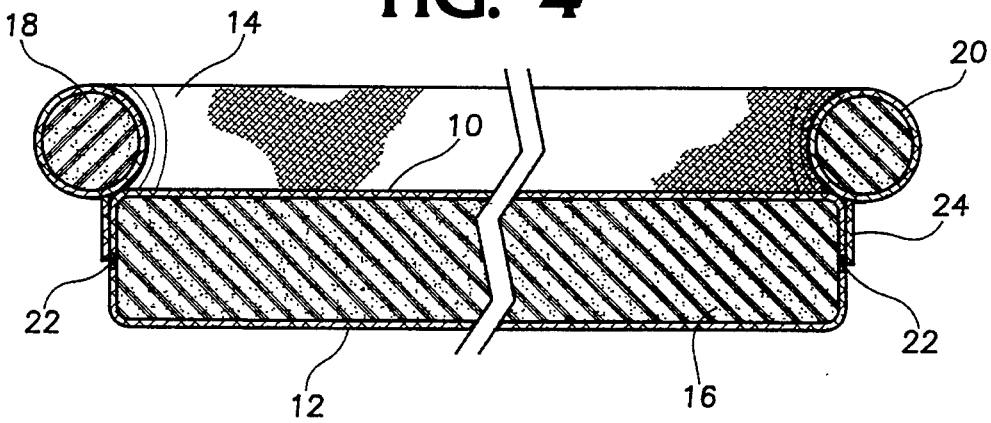
FIG. 4 is a cross sectional view of the invention with the protective pad in place.

FIGS. 3 and 4 show the cover of the invention in place on an infants cushion 16. The protective cushion 14 is formed of a flame retardant batting material or sponge rubber 18 and covered with the same material 20 as the cover 10 and 12. The upper and lower halves of the cover 10 and 12 respectively are joined on three sides by the sewn seam 22. Included in the seam is tab 24 from the protective cushion 14. This secures the safety protective cushion to the cover and allows it to extend above the cushion 12 regardless of which side (10 or 12) of the cushion receives the infant.

Figure 5:
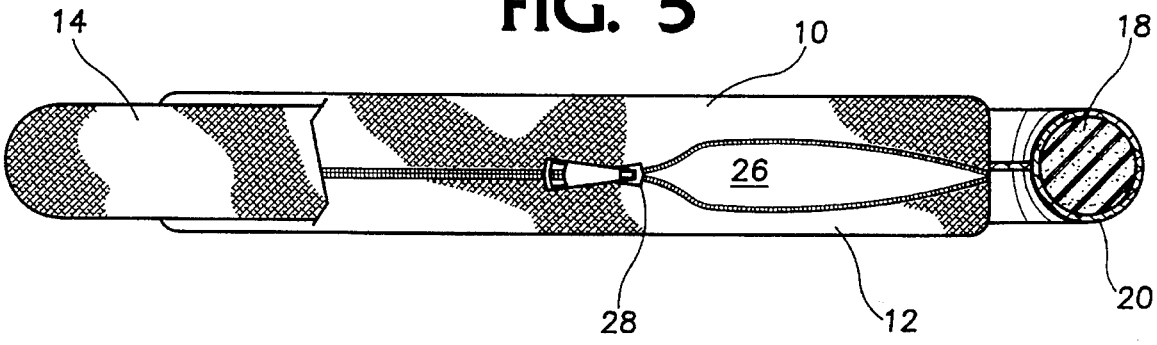
FIG. 5 is an end view of the invention showing the zipper closing means

In FIG. 5 the invention is seen from the end where a cushion would be inserted through slot 26 which is closed by the zipper 28 or a suitable substitute such as Velcro. The protective cushion 14 and its tab 24 are sewn into the seam along with the zipper to provide continuity around the entire cushion.

The invention may be sized to fit appropriate infant cushions from all types and designs of infant furniture. The cover is formed of flame retardant cotton/polyester blend fabric such as a durable yet economical cotton/polyester/percale material.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A reversible cover for an infant cushion comprising: a rectangular cushion adapted to fit infant's furniture; a first cover to enclose the top one half of the cushion; a second cover to enclose the bottom one half of the cushion; means for joining the two halves on three sides, means for releasably joining the two halves on the fourth side, a protection cushion with a generally circular cross section having a tab extending radially therefrom, the tab affixing the protective cushion to the reversible cover at the juncture of the first and second covers, around the perimeter of the infant cushion, whereby the protective cushion is positioned above the infant cushion independent of which side of the infant cushion is in position to receive an infant.

2. A reversible cover for an infant cushion according to claim 1 wherein: the means for joining the top and bottom halves on three sides is a thread sewn between the material of the top and bottom.

3. A reversible cover for an infant cushion according to claim 2 wherein: the top half and bottom half are formed of the same material.

4. A reversible cover for an infant cushion according to claim 3 wherein: the said material is a flame retardant cotton/polyester blend fabric.

5. A reversible cover for an infant cushion according to claim 3 wherein: the said material is a cotton/polyester/percale sheet material.

6. A reversible cover for an infant cushion according to claim 2 wherein: the means for releasably joining the two halves is Velcro.

7. A reversible cover for an infant cushion according to claim 2 wherein: the means for releasably joining the two halves is a zipper.

8. A reversible cover for an infant cushion according to claim 7 wherein: the zipper is nylon.

9. A reversible cover for an infant cushion according to claim 1 wherein: the protective cushion is covered with the same material as the said top half and bottom half.

10. A reversible cover for an infant cushion according to claim 9 wherein: the protective cushion is formed of a non flammable batting material.

11. A reversible cover for an infant cushion according to claim 9 wherein: the protective cushion is formed of sponge rubber.

* * * * *